US006353377B1

(12) United States Patent
Palmer

(10) Patent No.: US 6,353,377 B1
(45) Date of Patent: Mar. 5, 2002

(54) TRIP ASSEMBLY FOR CIRCUIT BREAKERS WITH SHOCK ABSORBING COMPONENTS

(75) Inventor: Neil Ray Palmer, Hallsville, MO (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 09/218,966

(22) Filed: Dec. 22, 1998

(51) Int. Cl.[7] ..... H01H 9/00

(52) U.S. Cl. ..... 335/172; 335/9; 335/21; 335/175

(58) Field of Search ..... 335/167–176, 335/21–25, 6, 9, 10

(56) References Cited

U.S. PATENT DOCUMENTS

| | | | | |
|---|---|---|---|---|
| RE31,813 E | * | 1/1985 | Fugate et al. | 335/271 |
| 5,369,384 A | * | 11/1994 | Heins | 335/171 |
| 5,937,439 A | * | 8/1999 | Barthold et al. | 2/10 |

* cited by examiner

*Primary Examiner*—Ramon M. Barrera
(74) *Attorney, Agent, or Firm*—Kareem M. Irfan; Larry I. Golden

(57) ABSTRACT

The present invention provides a spring for a tripping mechanism in a circuit breaker for connection to a circuit. The tripping mechanism has a first component which is accelerated along a predetermined path of travel to a trip release velocity upon occurrence of a trip event in the circuit and a second component which is initially stationary prior to engaging the first component. The spring includes a body for decreasing the trip release velocity of the first component prior to engaging the second component. A tripbar for a tripping mechanism in a circuit breaker for connection to a circuit is also provided. The tripping mechanism has an armature which is accelerated along a predetermined path of travel to a trip release velocity upon occurrence of a trip event in the circuit while the tripbar is initially stationary prior to engaging the first component. The tripping mechanism further includes a spring having at least two ends. The tripbar includes an elongated body having a surface which has a slot for inserting one end of the spring therein. The present invention also provides a trip assembly for a circuit breaker for connection to a circuit. The trip assembly includes a first component which is set in motion along a predetermined path of travel to a trip release velocity by a trip event in the circuit. A second component is initially stationary prior to engagement with the first component. The assembly also includes decreasing the trip release velocity of the first component before it engages a second component.

11 Claims, 6 Drawing Sheets

TRIP ASSEMBLY FOR CIRCUIT BREAKERS WITH SHOCK ABSORBING COMPONENTS

FIELD OF THE INVENTION

This invention relates to an assembly and method for absorbing the shock of an impact force on the components of a tripping mechanism of an circuit breaker during a fault current. More particularly, the preferred embodiment is a spring clip which is positively retained to a tripbar which absorbs the shock of a tripping mechanism moving at high velocity during a trip event.

BACKGROUND OF THE INVENTION

Circuit breakers use various trip mechanisms to disconnect the circuit when a pre-determined event has occurred. Often the components of the trip mechanism are required to move at a high velocity as the result of a trip event and impact one another causing stress which can lead to structural or mechanical failure of one or more of the components.

Some circuit breakers use a trip mechanism which includes an electro-magnet which generates high magnetic forces when subjected to high fault currents in a circuit. The magnetic forces attract an armature or other similar component in order to close a gap between the armature and the electro-magnet. Displacement of the armature causes it to travel and impact another component such as a tripbar to continue the tripping sequence. The velocity of the armature travel can result in breaking the tripbar or armature. This is particularly a problem when the components such as the tripbar are made of a plastic material like a high glass thermal set phenoic.

An example of the problem experienced by the prior art is illustrated in FIG. 1. A tripping mechanism, generally designated as reference numeral 10, includes an electromagnet 12 which generates high magnetic forces 14 when the circuit (not shown) which the tripping mechanism is protecting experiences high fault currents. An armature 16 has one end 18 which is attracted by the magnetic forces 14, moving the armature towards the electromagnet 12 at a high velocity. The other end 20 of the armature 16 forms a hat 22 which includes a flange 24. A tripbar 26 is positioned within the line of motion of the armature 16 so that the flange 24 engages an impact area 28 on the tripbar as the armature 16 moves toward the electromagnet 12. The impact area 28 is offcenter from the rotational axis 30 of the tripbar. As the armature 16 travels toward the electromagnet 12 causing the flange 24 to engage the impact area 28, the tripbar 26 rotates in a counterclockwise motion indicated by arrow 32. The rotation of the tripbar 26 can then open the circuit by using the circuit breaker's operating mechanism to open the contacts (not shown). The shock of the impact between the flange 24 striking the impact area 28 can cause the tripbar 26 to break.

There is a need for absorbing the shock of the impact between components of a trip assembly used in circuit breakers to prevent structural failure of the components.

SUMMARY OF THE INVENTION

The present invention provides a spring for a tripping mechanism in a circuit breaker for connection to a circuit. The tripping mechanism having a first component which is accelerated along a predetermined path of travel to a trip release velocity upon occurrence of a trip event in the circuit and a second component which is initially stationary prior to engaging the first component. The spring includes a body having integrally formed therein means for decreasing the trip release velocity of the first component prior to engaging the second component. The body is positioned along the pre-determined path of travel of the first component.

Preferably, the spring has a u-shape configuration which includes a bight defined between an upper leg and a lower leg. The upper leg defines a cantilever which extends from the bight to a far end. The far end has an upper surface defining a spring impact area for receiving engagement with the first component. The lower leg has means for mounting the spring to the second component.

The present invention also provides a tripbar for a tripping mechanism in a circuit breaker for connection to a circuit. The tripping mechanism has an armature which is accelerated along a predetermined path of travel to a trip release velocity upon occurrence of a trip event in the circuit while the tripbar is initially stationary prior to engaging the first component. The tripping mechanism further includes a spring having at least two ends. The tripbar includes an elongated body having a surface which has a slot for inserting one end of the spring therein. Means for stopping the deflection of the other end of the spring after the spring engages the armature is also included.

The present invention also provides a trip assembly for a circuit breaker for connection to a circuit. The trip assembly includes a first component which is set in motion along a predetermined path of travel to a trip release velocity by a trip event in the circuit. A second component is initially stationary prior to engagement with the first component. The assembly also includes means for decreasing the trip release velocity of the first component before it engages a second component.

The new and improved trip assembly of the present invention provides for the deceleration or shock absorption of the impact between two components.

It is an object of the present invention to prevent the breakage of components within a tripping mechanism that must engage when a trip event in the circuit releases the tripping mechanism.

Another object of the present invention is to provide a tripping mechanism which absorbs the impact shock between engaging components during a release of the mechanism while reliably resetting itself between trip events in the circuit.

Other and further advantages, embodiments, variations and the like will be apparent to those skilled in the art from the present specification taken with the accompanying drawings and appended claims.

BRIEF DESCRIPTION OF THE DRAWINGS

In the drawings, which comprise a portion of this disclosure, but are not to scale.

DETAILED DESCRIPTION OF THE INVENTION

Figure 1:
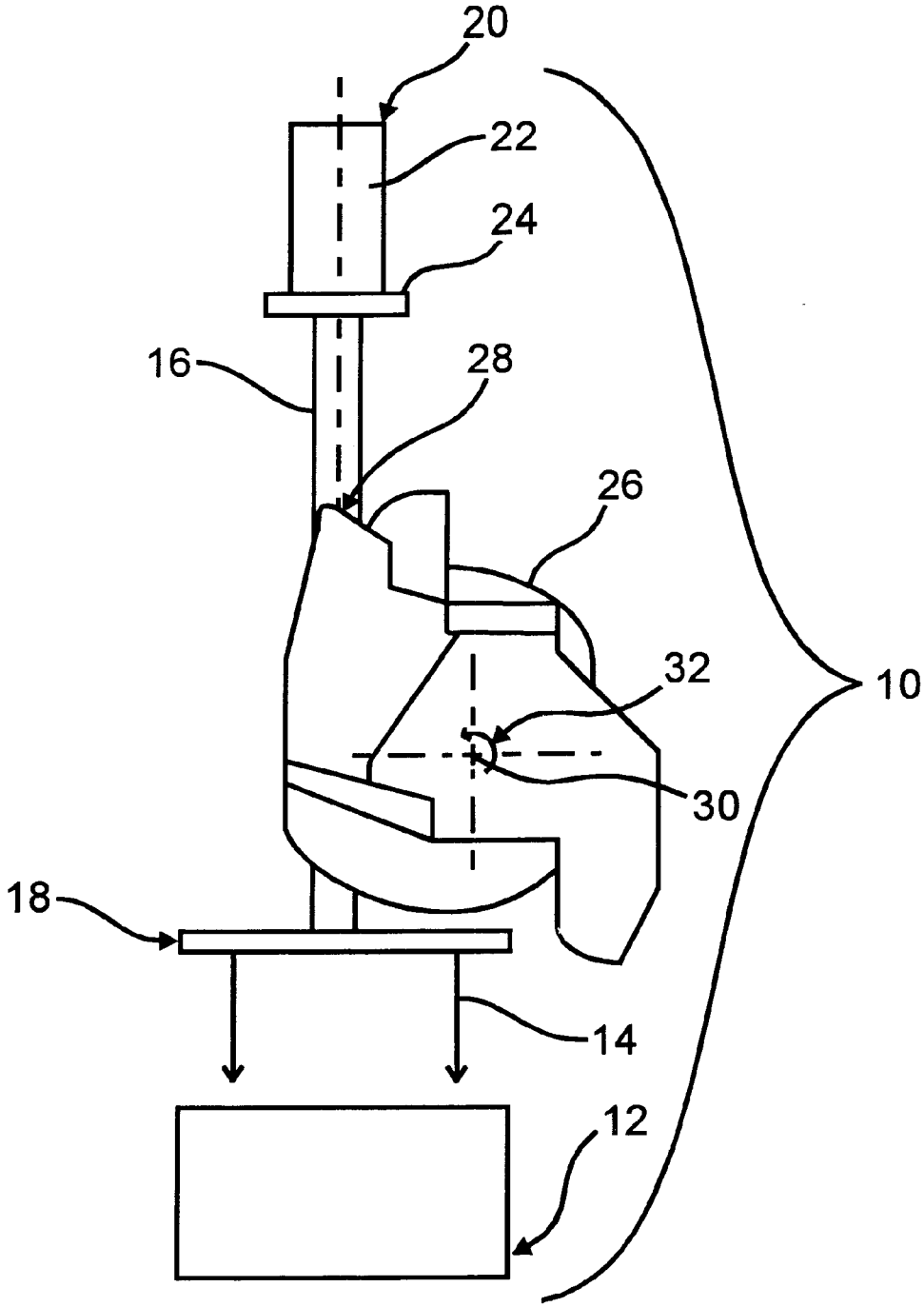
Fig. 1 PRIOR ART
FIG. 1 shows an isolated, side view of a tripping assembly of the PRIOR ART.
Figure 2:
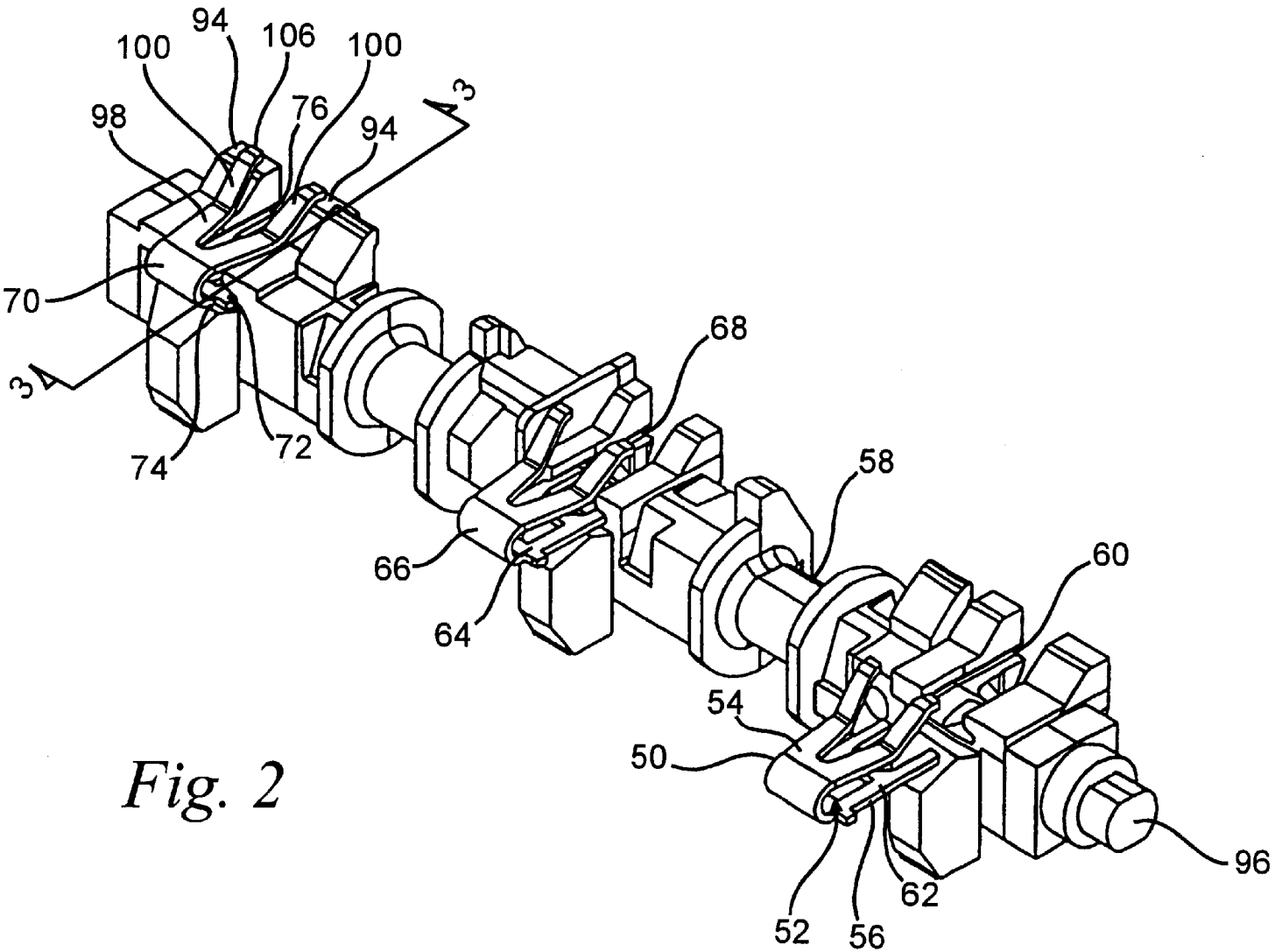
FIG. 2 is an isolated, perspective view of the inventive trip assembly for a circuit breaker including a tripbar and spring clip in various stages of assembly.
Figure 3:
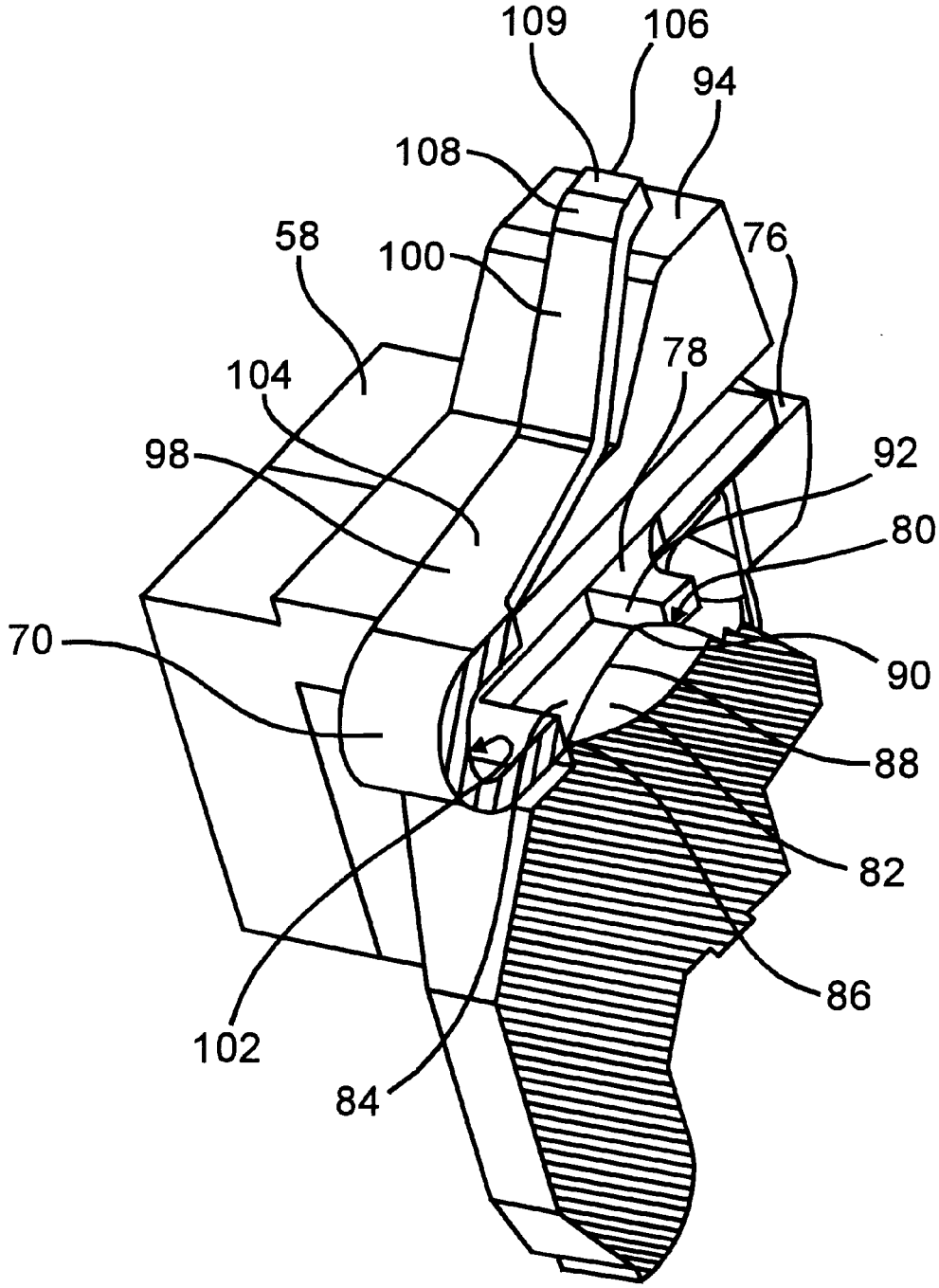
FIG. 3 is a cross-sectional view of the inventive trip assembly of FIG. 2 along the line 3—3.

Generally, the present invention provides means for decreasing the trip release velocity of one component before it engages a second component in a tripping mechanism for a circuit breaker. With reference to FIGS. 2 and 3, a preferred embodiment of the present invention is provided which includes a spring 50 defined by a u-shape configuration forming a bight 52 between an upper leg 54 and a lower leg 56.

A tripbar 58 which positively retains the spring 50 in connection therewith is also included in the preferred embodiment. Integrally formed with the tripbar 58 is a mounting slot 60 which receives the lower leg 56 of the spring. The lower leg 56 is split into two tines 62 which slide into the mounting slot 60. FIG. 2 specifically illustrates the progression of the spring 50 sliding into the mounting slot 60 with tines 64 of spring 66 partially engaging one of the mounting slots 68. Another spring 70 having tines 72 defining a lower leg 74 is depicted fully inserted into another one of the mounting slots 76.

FIG. 3 specifically illustrates positively retaining the spring 70 in the mounting slot 76 by having a securing tab 78 on each of the tines engage the far side 80 of a raised projection 82 integrally formed with the surface 84 of the tripbar 58. The raised projection 82 includes a near side 86 in close proximity to where the tines 72 enter the mounting slot 76. As the tines 72 are pushed further into the mounting slot 76, the securing tab 78 engages the near side 86 of the raised projection and begins to slide along an inclined ramp 88 between the near and far sides 86 and 80, respectively. As the securing tab 78 of each tine 72 continues to slide along the inclined ramp 88, the tine 72 themselves are deformed in a direction away from each other. Once the securing tab 78 slides over the far end 90 of the inclined ramp 88, the deformed tines 72 assume their original shape and move in a direction towards each other. Simultaneously, the near side 92 of the securing tab 78 abuts the far side 80 of the raised projection to positively retain the spring 70 in connection with the tripbar 58.

Referring to FIGS. 2 and 3, the tripbar 58 includes stop areas 94 upstanding on its surface for each tripping mechanism. The stop areas 94 are positioned offcenter from a rotational axis 96 of the tripbar. The upper legs of each of the springs like upper leg 98 of spring 70 are split to define two upper tines 100 which extend as a cantilever from the bight 102 from the near end 104 to the far end 106 of each tine. The upper face 108 of the far end 106 of each tine faces away from the tripbar 58 to define an impact area extending over a respective stop area 94.

Figure 4:
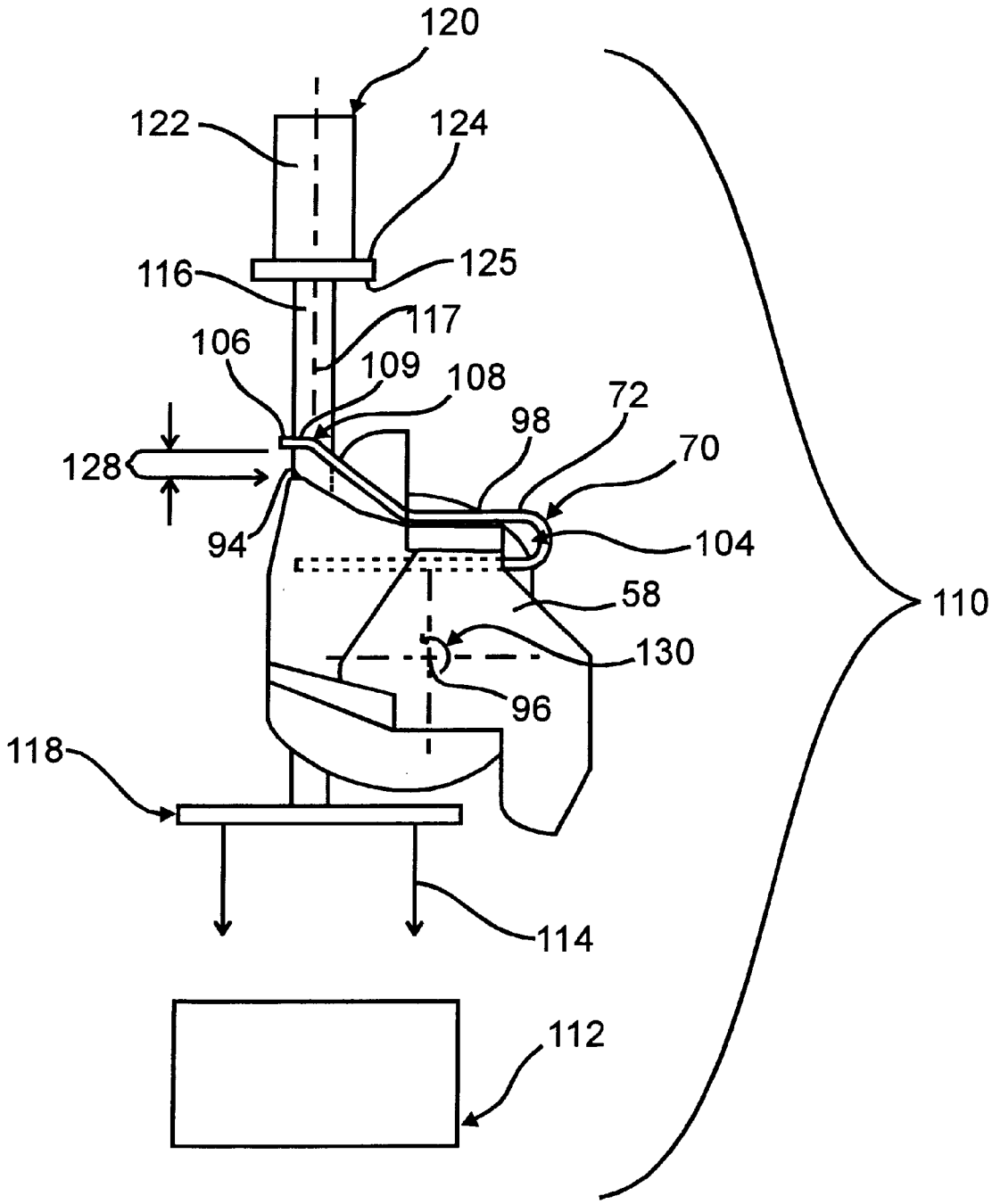
FIG. 4 is an isolated, side view of tripping mechanism including the inventive trip assembly of FIG. 2.

A tripping mechanism, generally designated as reference numeral 110 in FIG. 4, includes an electromagnet 112 which generates high magnetic forces indicated by arrow 114 when the circuit (not shown) which the tripping mechanism 110 is protecting experiences high fault currents. An armature 116 is one component of the tripping mechanism and is defined by a shaft 117 having one end 118 and the other end 120. The shaft 117 is sized and positioned to straddle between the two tines 72 of the spring 70. One end 118 of the shaft is directed toward the electromagnet 112. A hat 122 is formed at the other end 120 of the shaft which includes a flange 124. The flange 124 has an underside 126 which defines an armature impact area 125 on opposing sides of the shaft 117.

The far end 106 of each tine 72 on each spring 70 is raised above each stop area 94 on the tripbar a deceleration or shock absorbing distance 128 when the spring 70 is in its original, non-deformed shape. When a stress in the direction of arrow 114 is placed on the spring impact area 109 of each tine, the cantilever formed by each tine 72 deforms or bends to deflect the far end 106.

When the electromagnet 112 is energized by a trip event in the circuit, the magnetic force created accelerates the end 118 of the armature to a trip release velocity in the predetermined path of travel indicated by the direction of the arrow 114. The tripbar 58 is the second component of the tripping mechanism which will engage the first component. The tripbar 58 is positioned within the line of motion of the armature 116 so that the armature impact area 125 on the underside of the flange engages the spring impact area 109 on each tine 72 as the armature 116 moves toward the electromagnet 112. As the armature impact area 125 strikes the spring impact area 109, the shock of the striking engagement between them begins to be absorbed by the deflection of the end 106 of each tine toward the respective stop area. As a result of the energy absorbed by the deflection, the armature 116 begins to decelerate from the trip release velocity. The end 106 of each tine 72 continues to increase in its deflection until the full amount of the energy represented by the trip release velocity and electromagnetic force is absorbed by the spring 70 or the end 106 of each tine comes in contact with and is stopped by the respective stop area 94. The stop area 94 prevents over-stressing of the spring 70, so that it does not become permanently deformed.

The deflection of the spring 70 and its shock absorption across the deceleration distance 128 can be uniform or may follow a pre-determined gradient by using a spring with an asymmetric deflection. Thus, it may be preferred to increase or decrease the rate of deceleration of the armature 116 across the deceleration distance 128.

Since the spring impact areas 109 and the stop areas 94 are positioned offcenter from the rotational axis 96 of the tripbar, the force of the decelerating armature 116 causes the initially static or stationary tripbar 58 to rotate in a counterclockwise rotation about the rotational axis 96 as indicated by arrow 130. The rotation of the tripbar 58 can then open the circuit by using the circuit breaker's operating mechanism to open the contacts (not shown) as is well known in the art.

Each spring like 70 is preferably made of a deformable material which retains the memory of its original shape. When the stress on the spring 70 causing the deformation is removed it is desirable for the spring to return to its original shape. Steel and other metals and plastics meeting this criteria are also suitable.

Figure 5:
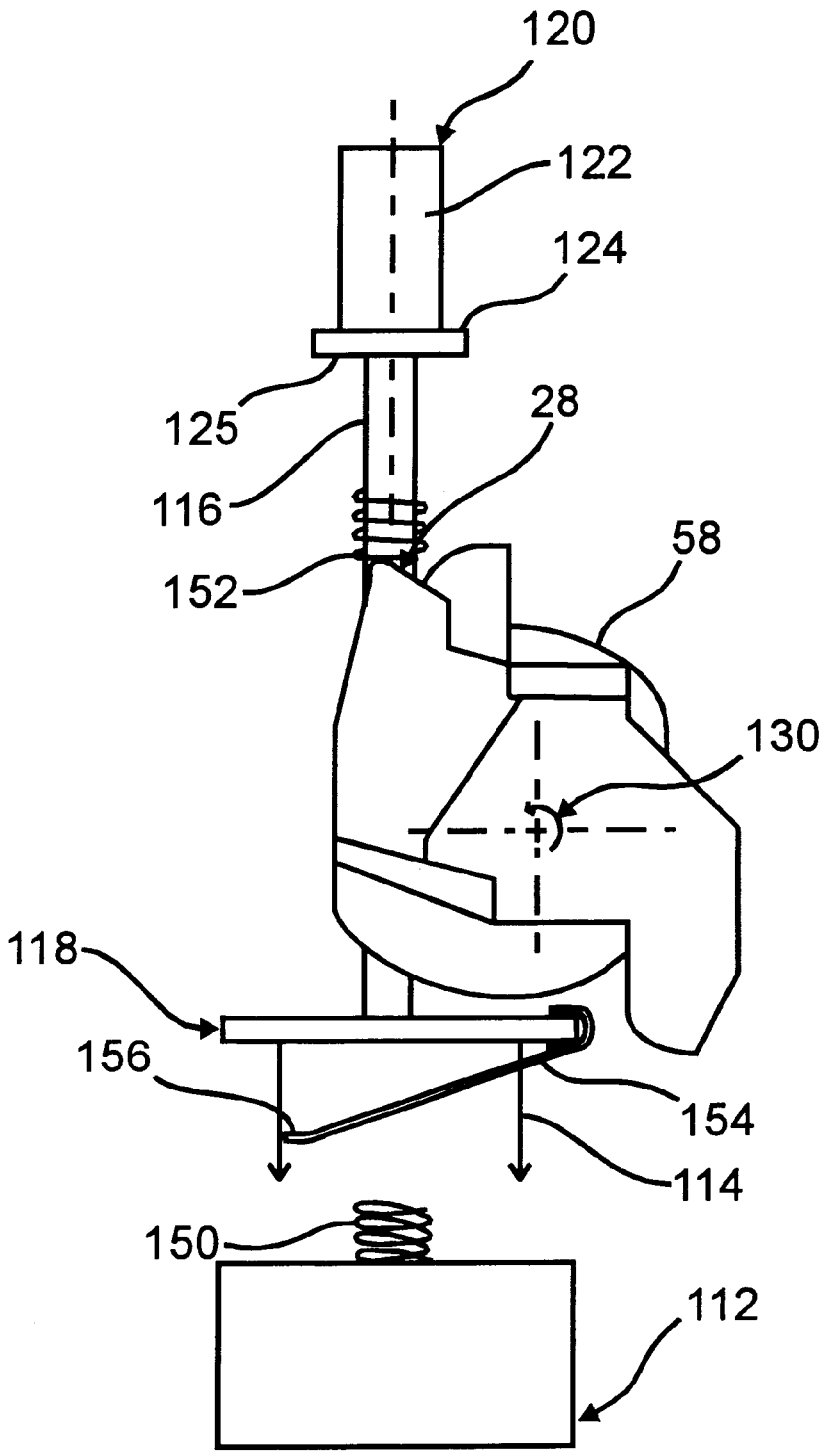
FIG. 5 is an isolated, side view of tripping mechanism including other spring embodiments inventive trip assembly.

Although the presently preferred embodiment of the present invention is illustrated in FIGS. 2–4, the present invention is not limited to the specific configuration of the spring nor its placement in the predetermined path of travel of the armature. For example and not limitation, FIG. 5 illustrates a number of other embodiments for the design and placement of the spring. A helical spring 150 is positioned in proximity of the electromagnet 112 in the travel path of the armature 116. The length of the helical spring 150 is predetermined to be sufficient to engage the end 118 of the armature just before the armature impact area 125 strikes the impact area 28 of the tripbar 58. The amount of deceleration needed can be controlled by the adjusting the length and/or stiffness of the helical spring 150.

Similarly, another helical spring 152 can be positioned around the armature 118 itself. One end of the other helical spring 152 abuts the impact area 28 of the tripbar while the other end of the helical spring 152 abuts the armature impact area 125 to decelerate the armature. One or both of the helical springs 150 and 152 can be used.

Another cantilever spring embodiment like 154 can be attached to the end 118 of the armature. One end 156 of the cantilever spring 154 engages the electromagnet to decelerate the armature 116 prior engaging the tripbar 58.

Figure 6:
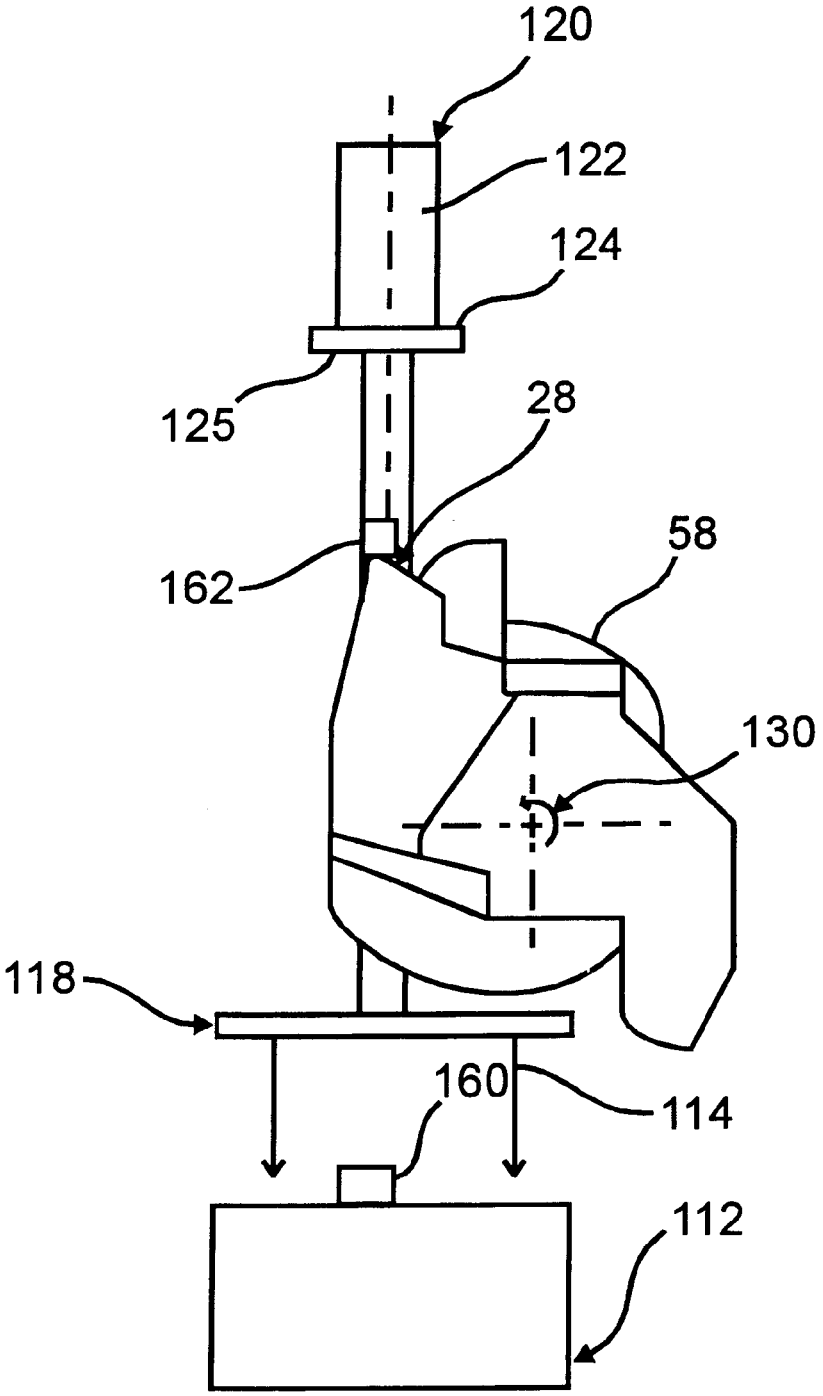
FIG. 6 is an isolated, side view of tripping mechanism including other means for decelerating the components of the inventive trip assembly.

The present invention also contemplates other means for decelerating the trip release velocity of the first component prior to engaging the second component. For example and not limitation, FIG. 6 illustrates several embodiments wherein a block of material like 160 is positioned on the electromagnet 112. The size of the material 160 is predetermined to be sufficient to engage the end 118 of the armature just before the armature impact area 125 strikes the impact area 28 of the tripbar 58. The amount of deceleration needed can be controlled by the adjusting the size and/or resiliency of the material 160. Preferably the material 160 is made of a deformable plastic which retains the memory of its original shape. When the stress on the material 160 causing the deformation is removed it is desirable for the material to return to its original shape.

Similarly, another block of material 162 can be mounted around the impact area 28 of the tripbar 58 itself. One end of the material 162 abuts the impact area 28 of the tripbar while the other end of the material 162 abuts the armature impact area 125 to decelerate the armature. One or both of the blocks of material 160 and 162 can be used.

Circuit breakers were constructed in accordance with the present invention and tested at 600 volts, 22,000 amps to compare failure rates of the inventive assembly with a conventional trip assembly. The present invention improved the failure rate of the tripbar by over about 20% compared to the prior art trip assembly.

Although one embodiment of an assembly of three tripping mechanisms has been specifically illustrated in the drawings, the present invention is not so limited. A single or any number of tripping mechanisms are also included. Nor is it a limitation of the present invention to use a spring with split upper and lower legs for either positioning the armature therebetween or mount the spring to the tripbar. A single or any number of impact areas can be used with each trip assembly or mechanism.

As those skilled in the art will appreciate, the inventive assembly can be adapted and configured for use with a wide variety of circuit breakers and other circuit interrupters. The present invention is suitable for use in low, medium, and high voltage applications and in various phase configurations. The term circuit breaker is defined to include all types of circuit interrupters as well as, but not be limited to, single or polyphase circuit breakers, vacuum or air breakers, fusible switches, and the like.

The preferred embodiment of the present invention is particularly useful with circuit breakers using an electromagnetic tripping mechanism such as the MAG-GARD (a registered trademark of the Square D Company) circuit breakers. The present invention, however, can be used with a tripping mechanism utilizing a trip release driven by a mechanical or other means besides a magnetic trip.

While particular embodiments and applications of the present invention have been illustrated and described, it is to be understood that the invention is not limited to the precise construction disclosed herein and that modifications, changes, and variations which will be apparent to those skilled in the art may be made in the arrangement, operation and details of construction of the invention disclosed herein without departing from the spirit and scope of the invention as defined in the appended claims.

What is claimed is:

1. A trip assembly for a circuit breaker for connection to a circuit, the trip assembly comprising:

a first component which is set in motion along a predetermined path of travel to a trip release velocity by a trip event in the circuit;

a second component which is initially stationary prior to engagement with the first component; and means for decreasing the trip release velocity of the first component before it engages said second component.

2. A spring affixed to a circuit breaker tripping mechanism, the circuit breaker tripping mechanism having an armature which is accelerated along a predetermined path of travel to a trip release velocity upon occurrence of a trip event and a tripbar which is initially stationary prior to engaging said armature, said spring comprising:

a body positioned along the predetermined path of travel of the armature for decreasing the trip release velocity of the armature prior to engaging the tripbar.

3. The spring of claim 2, wherein said body has a u-shaped configuration which includes:

a bight defined between an upper leg and a lower leg, said upper leg defining a cantilever which extends from said bight to a far end, said far end having an upper surface defining a spring impact area for receiving engagement with said armature, said lower leg having a plurality of tines for mounting the spring to the tripbar.

4. The spring of claim 3 wherein said plurality of tines engage a mounting slot of the tripbar, at least one of the tines having a securing tab which extends perpendicular to the tine, said securing tab positioned to spring-fit against a side wall of a corresponding projection of the tripbar.

5. The spring of claim 4 wherein said securing tab is positioned to be deformed by said corresponding projection before abutting against said side wall.

6. The spring of claim 2 wherein said body comprises a helical coil positioned around the armature.

7. The spring of claim 2 wherein said body is a block of resilient, deformable material which is mounted on an impact area of the tripbar.

8. The spring of claim 7 wherein said block material retains memory of its original shape following separation of the armature and the tripbar.

9. The spring of claim 8 wherein said block material comprises a deformable plastic.

10. A tripbar for a circuit breaker tripping mechanism, the circuit breaker tripping mechanism having an armature which is accelerated along a predetermined path of travel to a trip release velocity upon occurrence of a trip event while the tripbar is initially stationary prior to engaging the armature, the circuit breaker tripping mechanism further including a spring having at least two ends, the tripbar comprising:

an elongated body having a surface, the surface having a slot for inserting one end of the spring therein; and a stop area upstanding from the surface of the tripbar for stopping the deflection of the other end of the spring after the spring engages the armature.

11. The trip bar of claim 10 wherein the tripbar includes a projection raised above the surface of the tripbar and integrally formed therewith, the raised projection positioned near the mounting slot for abutting a side of the spring.

* * * * *